United States Patent [19]

Roth

[11] 3,936,529

[45] Feb. 3, 1976

[54] ORIENTED PHOTOEMITTERS

[75] Inventor: Walter Roth, San Diego, Calif.

[73] Assignee: Diagnostic Instruments, Inc., San Diego, Calif.

[22] Filed: Aug. 21, 1972

[21] Appl. No.: 282,028

[52] U.S. Cl. ..... 427/36; 427/78; 156/610

[51] Int. Cl. ..... H05b 33/28; B44d 1/44

[58] Field of Search ..... 117/201, 107, 62, 93.3, 117/227, 200, 211; 250/492

[56] References Cited

UNITED STATES PATENTS

| | | | |
|---|---|---|---|
| 3,219,451 | 11/1965 | Valle | 117/107 |
| 3,463,663 | 8/1969 | Chopra | 117/107 |

OTHER PUBLICATIONS

Tu K.N., IBM Tech. Bull., Vol. 13, No. 12, Oriented Metallic Films, pp. 3824–3825, (May, 1971).

Powell et al. Vapor Deposition, Wiley & Son, Inc., N.Y., p. 171, (1966).

Curzon A. E. et al., J. Appl. Physics, Simple Technique . . . Specimens, Vol. 5, No. 5, (1972, Feb.), pp. 1046–1048.

*Primary Examiner*—Cameron K. Weiffenbach
*Assistant Examiner*—Michael F. Esposito

[57] ABSTRACT

An improved photoemissive layer in apparatus for ionography and methods of increasing the photoemissivity of formed layers of photoemissive material involving depositing the photoemissive material on a substrate so that it will be oriented along a chosen lattice plane, such as the <111> plane.

7 Claims, 5 Drawing Figures

EXPOSURE TIME

ORIENTED PHOTOEMITTERS

BACKGROUND OF THE INVENTION

In copending patent application Ser. No. 431,020, filed Jan. 7, 1974, which is a continuation of Serial No. 158,172, filed June 30, 1971, now abandoned there is disclosed a process known as ionography which utilizes a photoemissive layer disposed on a suitable conductive substrate spaced from a second conductive layer having an insulative receptor material in the form of a sheet or the like disposed thereon. A d.c. voltage is applied across the gap between the conductive plates such that one is positive and one is negative. The arrangement can be utilized to make X-ray images of an object placed adjacent one of the plates between that plate and an X-ray source. The photoemissive layer is preferably an efficient absorber of X-rays. In the early work in the field of ionography, such as that disclosed by K. H. Reiss in Z. Angew, Physik, Volume 19, page 1 (1965), a heavy metal such as lead was utilized as a photoemitter. A quenching gas is flowed or may be stationary within the gap between the plate electrodes. When an object is disposed adjacent the anode and is irradiated by X-rays or gamma rays, the electromagnetic radiation is differentially absorbed by the object and passes through the transmissive anode and insulative layer affixed thereto, and across the gap to strike the photoemitter where it is strongly absorbed by the photoemitter. As a consequence, the photoemitter ejects electrons having energies up to many kilo-electron volts. The number of electrons emitted is dependent upon the number of X-ray photons absorbed in that portion, the depth of absorption and the photon energy. On leaving the photoemitter surface, the electrons find themselves in the d.c. field between the electrodes and travel toward the positive electrode. The quenching gas serves to slow down the electrons so that they will not scatter when reaching the insulator and to increase their number by secondary ionization. Upon arrival at the insulator surface, the electrons and any negative ions which may have been formed by attachment to components of the quenching gas are collected in an image configuration forming a latent electrostatic image consisting of negative charges corresponding to elements or portions of the object which are relatively transparent to X-rays, and no charges or fewer charges corresponding to portions of the elements of the object which are opaque or relatively opaque to X-rays. The latent image is then made visible by development or by cathode ray tube display techniques.

One of the most significant limitations in the foregoing ionographic process is the photo-emissivity of the photoemissive layer. Since the electrons emitted are dependent upon the number of X-ray photons absorbed, the level of X-ray exposure has a significant impact on the results to be achieved in the ionographic process. One of the major advantages of the ionographic process as compared to normal X-ray techniques utilizing silver halide film is its ability to produce X-ray images with reduced X-ray exposure. As it known, it is most advantageous to be able to reduce the duration of X-ray exposure when individuals are being X-rayed. One way in which this can be accomplished in the inorgraphic process is by providing a photoemissive layer or material that has increased photoemissivity such that results equivalent to those obtainable with longer X-ray exposure periods can be achieved at shorter durations. In other words, it is highly desirable that sufficient electrons be produced by the photoemissive layer to achieve formation of a satisfactory latent image on an insulative substrate with reduced X-ray exposure. Heretofore, little effort was directed toward attempts at improving the photoemissivity of the photoemissive layer or the photoemissive layer utilized in the process of ionography. It was not heretofore known, for example, to employ as an ionographic photoemitter a material in the form of a thin film such as gold epitaxially grown on a substrate such as mica. However, it is known that gold can be epitaxially grown on mica. For example, see the paper by H. L. Chopra and L. C. Bobb entitled. "Electrical Conduction of Thin Epitaxially Grown Gold Films," *Proceedings, International Conference on Single-Crystal Films*, Blue Bell, Pennsylvania, May 1963. A related reference mentions lead deposition as well: "Thin Film Phenomena" by K. L. Chopra, McGraw-Hill, N.Y. 1966 (especially pages 225 and 236).

SUMMARY OF THE INVENTION

Among the objects of the invention are the provision of a photoemissive layer having increased photoemissivity and the provision of such an improved photoemissive layer for use in the process of ionography permitting reduced X-ray exposure of subjects whose image is formed ionographically.

A further object of this invention is to provide an improved ionographic system including a photoemissive layer having increased photoemissivity.

Another object of this invention is the provision of improved methods of forming photoemissive layers having increased photoemissivity.

These and other objects of this invention are accomplished by the present invention involving, briefly, formation of an oriented crystalline photoemissive layer on a suitable substrate. Preferably, the substrate chosen has lattice planes upon which the crystalline layer can be epitaxially deposited in a preferred crystallographic orientation so as to have significantly improved photoelectron yield as compared to a photoemissive layer of the same material having a different orientation.

DESCRIPTION OF THE PREFERRED EMBODIMENTS

Figure 1:
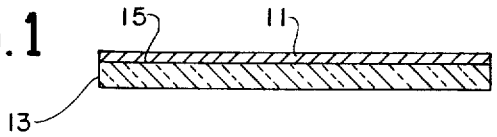
FIG. 1 is a cross-section of an oriented photoemissive layer disposed on a suitable substrate.

As indicated above, the process of ionography is dependent upon the number of electrons emitted from the photoemissive surface when activated by an X-ray source. In order to obtain a latent image of sufficient density so that it can subsequently be developed so as to be practicably useful, there must be sufficient electrons emitted from the photoemitter. The electron range, R, of a photoemissive material is defined by the distance in the photoemissive material which an electron can travel before it loses all of its engergy. It can thus be seen that the electron range is an important factor in considering and selecting photoemitters, and particularly in determining at least the maximum thickness of the photoemissive surface utilized. Since it is desirable and necessary in the process of ionography for the electrons to actually leave the photoemissive material and to travel toward a receptor, a photoemissive layer having a thickness greater than the electron range of the material is not useful for ionography since some of the electrons would only travel within the material itself and not escape therefrom to form an image.

It can be seen from the following equation that the electron range of the photoemissive layer is dependent upon the electron energy to some power greater than one. The electron energy is in turn dependent upon the X-ray energy.

$$R = \frac{250 A E^{n}}{\rho Z^{n/2}} \text{ where:}$$

R= electron range (Angstroms)
A= atomic or molecular weight of material, gm/mole
E= electron energy (KeV)
Z= total number of electrons in atom or molecule
$\rho$= density of material (gm/cc)

$$\text{and } n = \frac{1.2/1 - (0.29 \log Z)}{1.29 \log Z}$$

See C. Feldman, *Physical Review*, Vol. 117, p. 455 (1960). It can now be seen that if the electron range of the material forming the photoemissive layer is increased, one can increase the effective electron yield by increasing the thickness of the layer, since the electrons can travel a greater distance before losing their energy. In other words, more electrons will be emitted from a thicker layer if the layer is of a material having increased electron range. Thermionic It has been reported in the *Handbook of thermionic Properties* by V. S. Formenko, published by Plenum Press Data Division, p. 55 (1966) that thermionic electron emission from a single crystal of silicon was anisotropic and was most efficient when the <111> plane was facing the electron detector However, prior to the present invention, there was no concern for the orientation of photoemissive layers or for the effect of crystallographic orientation on the electron range of a photoemissive material. Further, there has previously been no suggestion of utilizing a photoemissive layer of a preferred crystallographic orientation in an ionographic process and apparatus. In accordance with the present invention, a photoemissive layer for ionography is crystallographically oriented along a preferred lattice plane to provide an increase in the electron range of that material and thus effectively to increase the photoemissivity of the layer.

It should be pointed out that in a normal photoemitter the planes of the polycrystalline material are relatively randomly oriented with no concern for a particular preferred orientation. However, even if no specific attempt is made to orient the photoemissive material, by utilizing some known techniques for depositing photoemissive layers one will inherently obtain a preferred crystallographic orientation for a particular material. For example, when a crystalline photoemissive layer is deposited on a substrate by sputtering or by vacuum deposition, the photoemissive material can achieve an inherently preferred crystallographic orientation. For a given material this preferred crystallographic orientation is not necessarily the orientation at which that material will have an improved electron range. For example, utilizing one of the above-mentioned sputtering or vacuum deposition techniques, one can deposit a crystalline photoemissive material on a substrate in such a way that the deposited layer will have a particular preferred plane of crystallographic orientation. This does not mean that it will be completely oriented in a given plane but that most of the material will be so oriented. This deposition of the photoemitter in a preferred plane of crystallographic orientation may not increase the electron range of the emitter any more than depositing the same photoemitter by a different technique which results in a random disposition of planes. Thus, through trial and error, one can preferably orient given photoemissive materials in differing oriented layers and determined which orientation provides for the maximum increase in electron range. It should be understood that such experimentation could well indicate that for a given photoemissive material the maximum electron range is obtained when that material is not oriented in its own preferred crystallographic orientation, though the same might not necessarily hold for many or most photoemissive materials. Achieving such orientation would require the use of some external means for orienting the material in an orientation other than that normally preferred.

It has been found, as will be shown in the specific examples, that when a known good photoemissive material such as the layer of lead shown in FIG. 1 is deposited on a mica substrate 13, the lead will be oriented with its <111> plane parallel to the <001> plane of the mica. The mica, a pseudohexagonal monoclinic crystalline substance, utilized for sheet 13 is initially cleaved so that the surface 15 of the mica is the <001> plane. Mica is of particular advantage here since it can readily be obtained (cleaved) oriented in the <001> plane. The lead 11 can then be vacuum evaporated onto the surface 15 so that the lead becomes epitaxially oriented on the mica in the <111> plane. It has been found that, when the lead is so deposited and oriented on the mica substrate, a significant increase in photoemissivity is obtained as compared to that of a lead photoemissive surface having random crystallographic orientation.

In particular, it has been found that lead on a mica substrate, as illustrated in FIG. 1, when utilized in an ionographic process and subjected to a series of X-ray exposures, experiences a decrease in photoemissive yield with time to a given stabilized level, as will be further shown in the examples. When gold is epitaxially deposited on mica with its <111> plane parallel to the <001> plane of the mica, there is also found to be an increase in the photoemissivity of the gold layer. Unlike lead, however, the photoemissive yield from gold does not appear to deteriorate with X-ray exposure. Though it has not been specifically determined why the yield from lead decrease to a stable level, possible mechanisms include X-ray induced chemical reaction such as oxidation, radiation-induced damage to the crystalline structure, or erosion of the surface crystalline microhillocks by ion bombardment. Even though the photoemissive yield of such an oriented lead layer decreases with X-ray exposure, it nonetheless stabilizes at a level significantly above that of a lead layer having random crystallographic orientation. The invention is illustrated by the following examples:

EXAMPLE 1

Figure 2:
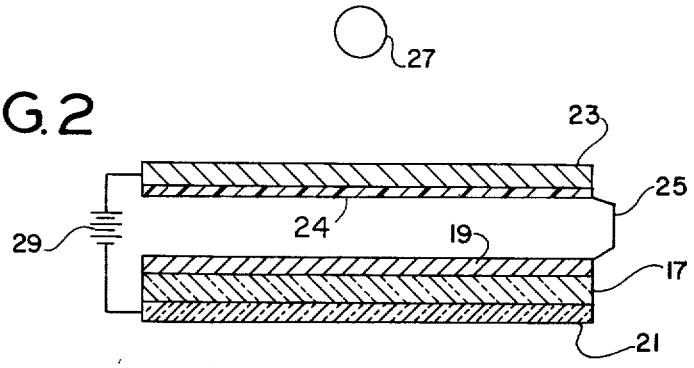
FIG. 2 is a schematic representation of an ionographic system.

A 5×7 inch sheet of mica was cleaned by glow discharge. A gold layer was then vacuum deposited to a thickness of 20 microns at a slow rate, heating of the substrate being permitted to facilitate epitaxial deposition. As schemiatically represented in FIG. 2, mica substrate 17 with a gold layer 19 thereon was secured to a 5×7 inch glass backing plate electrode 21 by an adhesive, and the three-layer plate was then utilized in an ionographic arrangement. A conventional electrode plate 23 having an insulative receptor surface 24 was spaced from the photoemissive surface to provide a gap 25 of 14 mils therebetween which was filled with argon flowing at the rate of 50 cc/min. The X-ray exposure rate was 250 mR/sec. from a Machlett molybdenum target tube 27 with settings of 30 kVp and 100 mA. The distance from the target to the photoemissive layer was 27 inches. Townsend curves were obtained by incrementally increasing the voltage from a power supply 29 connected across the two plates and measuring the resulting current at each voltage.

The same process was repeated utilizing a gold layer on a glass substrate. The gold layer was deposited on the glass substrate by vacuum evaporation in a generally random crystallographic orientation, glass having no appreciable effect upon orientation.

Figure 3:
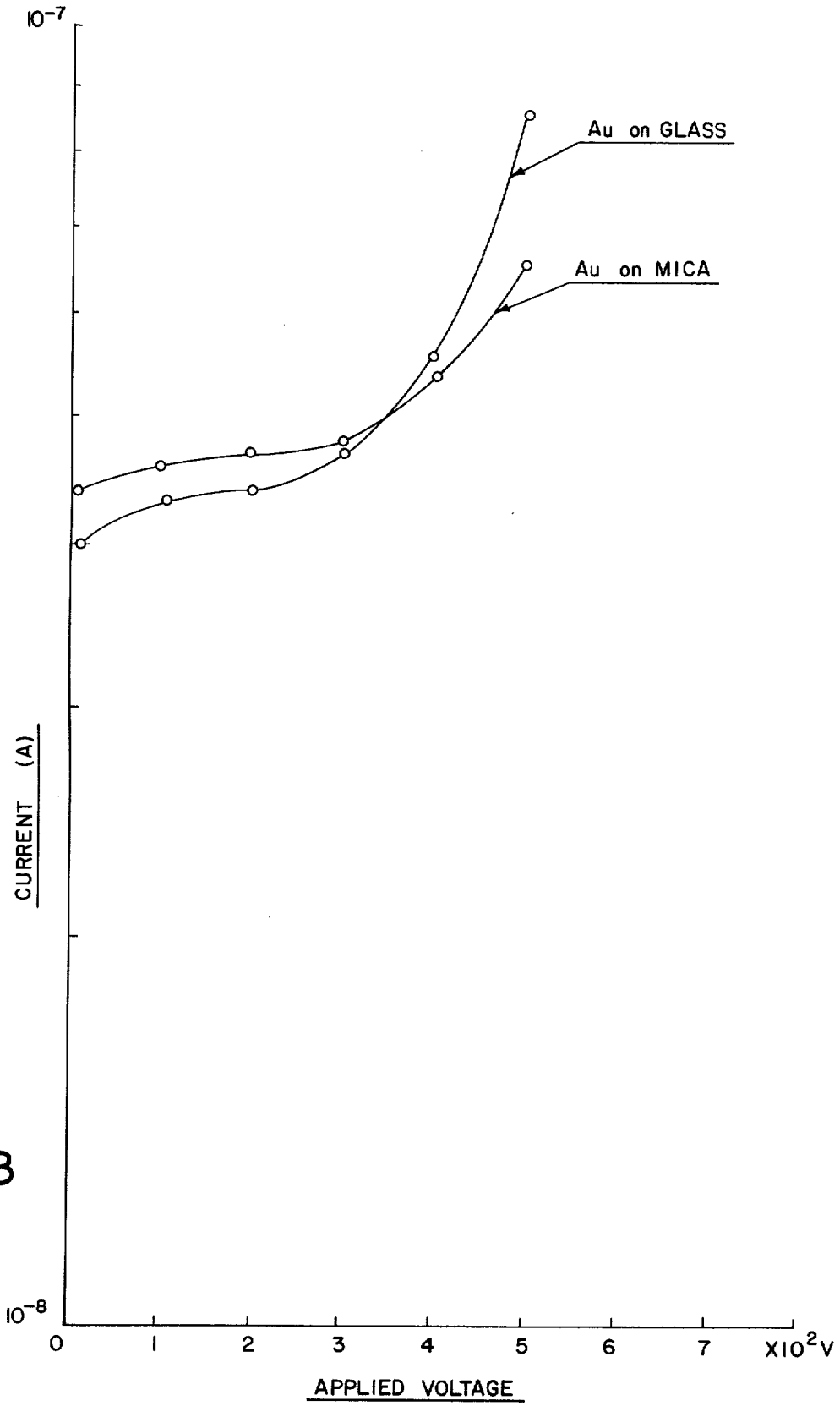
FIG. 3 is a depiction of Townsend curves for a gold photoemissive layer deposited on glass and mica substrates in accordance with the invention.

FIG. 3 is a plot of Townsend curves obtained with the gold on the two different substrate materials. Little or no gas multiplication occurs in the plateau regions, which extends approximately between 10 and 300 volts. Thus, the current level of the plateau is proportional to the photoemission yield. An increase of about 7 percent photoemissive yield in the plateau region is seen for the gold on mica (the gold being oriented in the <111> lattice plane) as compared with the yield from the randomly oriented, i.e., nonoriented, gold on glass. The fact that the gold deposited on the glass yielded a higher current output beyond the plateau region as compared to the gold on the mica is not germane in this context because this effect is due to electron multiplication in the gas rather than to photoemission from the gold.

EXAMPLE 2

Figure 4:
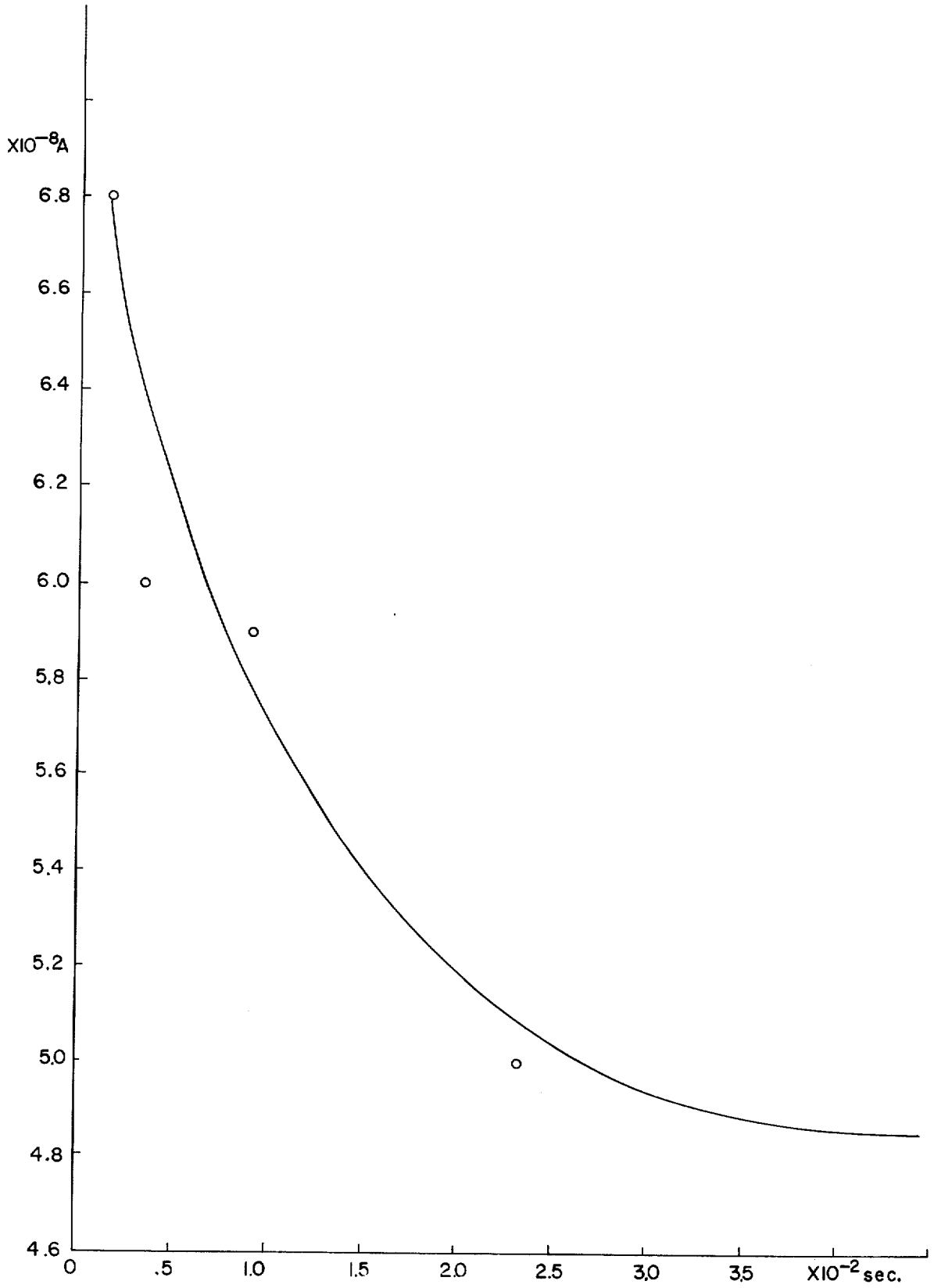
FIG. 4 is a yield degradation curve for a lead photoemissive layer on a mica substrate where the surface is continually exposed to X-ray radiation.

The procedure outlined in Example 1 was repeated using lead as the photoemitter. In one instance, lead was deposited on mica to a thickness of 20 microns, and for comparison a 20-micron layer of lead was also deposited on a glass substrate by vacuum evaporation. It was found that the electron emission of the lead on the mica decreased during a series of X-ray exposures. The effect of exposure on photoemissive yield is seen in FIG. 4. The photoemissive yield from a radiation-degraded lead/mica plate can be partially restored and stabilized at a higher level than that indicated in FIG. 4 by annealing the degraded lead/mica plate by heating it for 48 hours at about 100°C.

Figure 5:
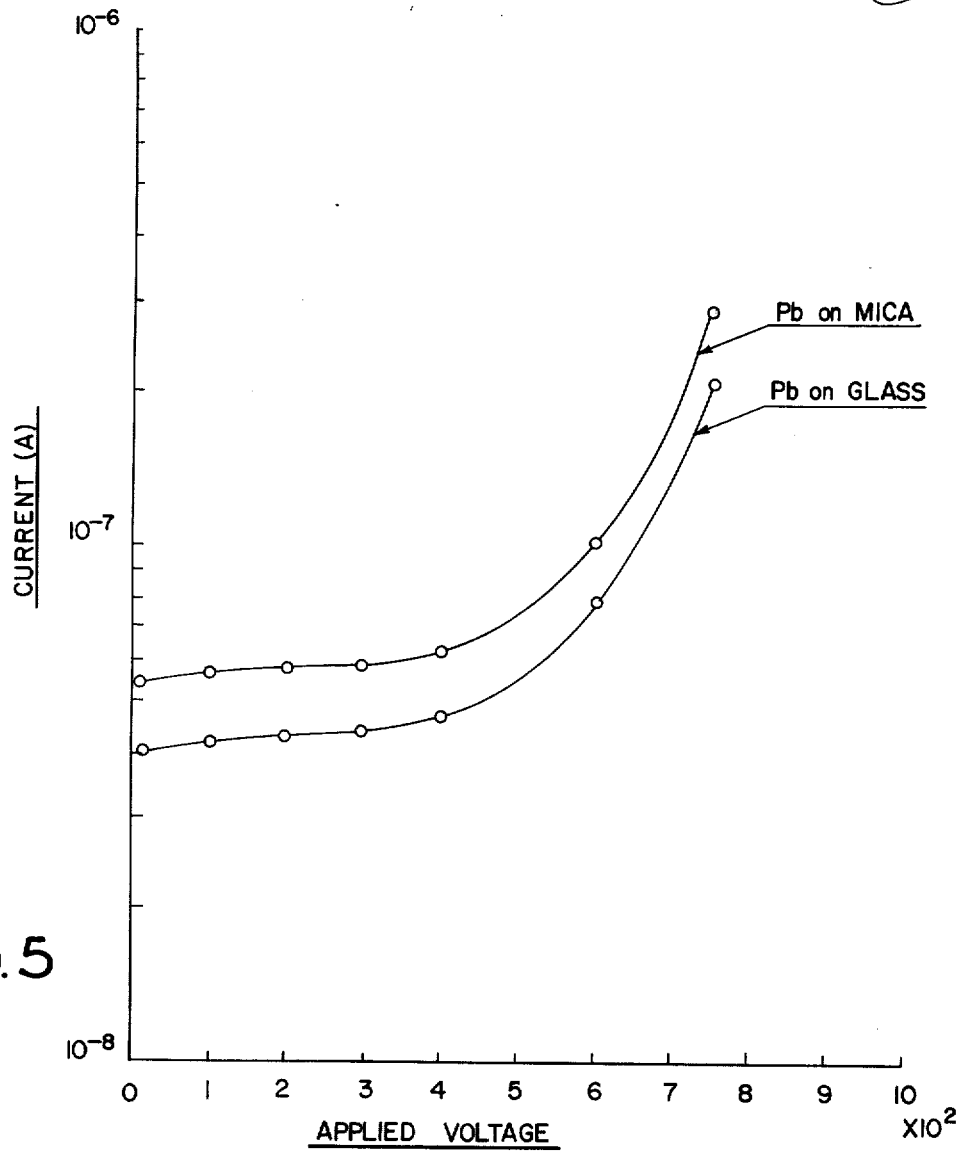
FIG. 5 depicts Townsend curves for a lead photoemissive layer on mica and glass substrates in accordance with the invention but following continued X-ray exposure thereof and after stabilization has occurred.

FIG. 5 shows the Townsend curves obtained with the lead on glass and the stabilized lead on mica plates. The intial difference in electron yield between the oriented lead on mica as compared to the non-oriented lead on glass before stabilization was 60 percent. However, as shown in FIG. 5, after stabilization of the lead on the mica substrate the electron yield was still greater by a substantial amount, on the order of 38 percent.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of forming an improved ionographic photoemitter comprising: selecting a substrate of mica; depositing on the substrate a layer of a photoemissive material consisting of lead, the photoemissive material being deposited in a preferred crystallographic orientation providing relatively high photoemissivity; subjecting the photoemissive material to x-ray exposure, causing a decrease in the photoemissive yield thereof; and annealing the photoemissive material on the substrate to partially restore and stabilize the photoemissive yield thereof.

2. A method as set forth in claim 1 wherein the photoemissive material is subjected to X-ray exposure until the photoemissive yield decreases to a first stabilized level, and annealing the photoemissive material on the substrate to partially restore the photoemissive yield thereof to a second stabilized level, the second stabilized level being higher than the first.

3. A method as set forth in claim 1 wherein the photoemissive material is deposited with its (111) lattice plane oriented parallel to the (001) lattice plane of the mica substrate.

4. A method as set forth in claim 2 wherein the annealing is carried out at a temperature of about 100° C. for a period of about 48 hours.

5. A method as set forth in claim 3 wherein the photoemissive material is deposited as an epitaxial layer.

6. A method as set forth in claim 5 wherein the photoemissive material is deposited by vacuum evaporation.

7. A method as set forth in claim 6 wherein the photoemissive material is deposited to a thickness of about 20 microns.

* * * * *